US005743819A

United States Patent [19]

Chun

[11] Patent Number: 5,743,819

[45] Date of Patent: Apr. 28, 1998

[54] GOLF TEE SETTER

[76] Inventor: Won Ho Chun, 2007 Wren Way, Fullerton, Calif. 92833

[21] Appl. No.: 742,057

[22] Filed: Oct. 31, 1996

[51] Int. Cl.[6] ..... A63B 69/36

[52] U.S. Cl. ..... 473/386; 473/397

[58] Field of Search ..... 473/386, 387, 473/392, 393, 394, 396, 397, 398, 400, 401, 402, 403

[56] References Cited

U.S. PATENT DOCUMENTS

| | | | |
|---|---|---|---|
| 1,550,483 | 8/1925 | Wulkop | 473/393 |
| 1,783,733 | 12/1930 | Manassero | 473/393 |
| 1,803,907 | 5/1931 | Kruse | 473/398 |
| 4,336,940 | 6/1982 | Sprague | 473/386 |
| 5,052,689 | 10/1991 | Lettrich | 473/386 |
| 5,156,403 | 10/1992 | Martino | 473/396 |
| 5,413,348 | 5/1995 | Basso | 473/393 |

*Primary Examiner*—Steven B. Wong

[57] ABSTRACT

A golf tee setter according to the present invention allows golfers to use a real tee on a practice mat to practice their swing in golf driving ranges as if they are actually practicing on real ground. The golf tee setter is configured to be placed in the rubber tee hole of the practice mat and has a slit formed in a tee holder to hold the tee in substantially vertical position in relation to the practice mat to place a golf ball on the tee. The golf tee setter also includes a base plate coupled to a bottom portion of the first member having a slightly larger diameter than the tee holder and the tee hole to allow a top portion of the tee holder to slide into the tee hole until the base abuts the practice mat. A cord tethers the golf tee and the golf tee setter for repeated use of the golf tee.

18 Claims, 4 Drawing Sheets

GOLF TEE SETTER

BACKGROUND OF THE INVENTION

1. Field of the Invention

This invention relates to golf tees, and more particularly, to an apparatus used in conjunction with golf tees and a practice mat to place a golf ball.

2. Description of Related Art

Golf is one of the most widely played sports activities in the United States. Not only is this activity already widespread, but the number of golfers continue to grow due to popularity of the sports caused by high stake games televised on televisions.

The sport of golf is typically played on a course consisting typically of eighteen holes. A set of clubs is used to strike a golf ball in each hole. Each hole has a tee box which defines a starting location of that hole in which a golfer places a golf ball and swings a golf club to strike the ball towards a designated green. Before striking the golf ball, the golfer first places a tee into the ground and then places a golf ball on the convex surface of the tee. Upon a proper impact of the golf ball with a club, the tee will either eject from the ground due to the impact of the club. In some instances, the impact of the club breaks the tee into two pieces rendering the tee unusable.

Typically, prior to playing on a golf course, golfers practice their swing in golf driving ranges which are equipped with artificial practice mats and rubber tees. The condition of the rubbers tees, however, varies among practice mats, and thus does not render optimum practicing condition for golfers. As a result, a golfer must adapt to such a condition to practice golf swings. For example, if a golfer desires a higher tee, such condition cannot be provided with a rubber tee, because its height is fixed for the particular practice mat. The reverse is also true if the golfer desires a lower tee. In addition, the condition of teeing off from a real tee, which is typically made of wood, cannot be emulated with a rubber tee.

In addition, existing rubber tees are fixed in height and are easily damaged when golf club heads hit golf balls. Also, rubber tees produce severe friction force against a golf ball because of a large contact surface area on the golf ball.

SUMMARY OF THE DISCLOSURE

It is an object of the present invention to provide a golf tee setter for a practice mat to allow placing a tee in the tee setter to provide a golfer with an appropriate practice condition. With the present invention, golfers are able to use a real tee even on practice mats as if they would set it on actual golf field ground. Golfers can place a golf ball at any height. When the head of a golf club hits a golf ball, friction against the tee setter is almost eliminated and thus reducing damages to the tee setter.

According to one embodiment of the present invention, the golf tee setter is configured to be placed in the tee hole of the practice mat and has a slit formed in a tee holder to hold the tee in substantially vertical position in relation to the practice mat to place a golf ball on the tee. The golf tee setter also includes a base plate coupled to a bottom portion of the tee holder. The base plate has a slightly larger diameter than the tee holder and the tee hole of the practice mat to allow a top portion of the tee holder to slide into the tee hole until the base abuts the practice mat. A cord having first end and second end tethers the golf tee and the golf tee setter for repeated use of the golf tee.

According to a further aspect of the golf tee setting device, the cord may be elastic or non-elastic. The first end of the cord is of substantially a ring shape to insert the tee holder therein. The tee holder includes a groove formed on the outer circumferential surface to accommodate the first end of the cord. Similarly, the second end of the cord is of substantially a ring shape to insert the golf tee therein.

According to another aspect of the golf tee setting device, the height of the first member is substantially the same as the thickness of the practice mat.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
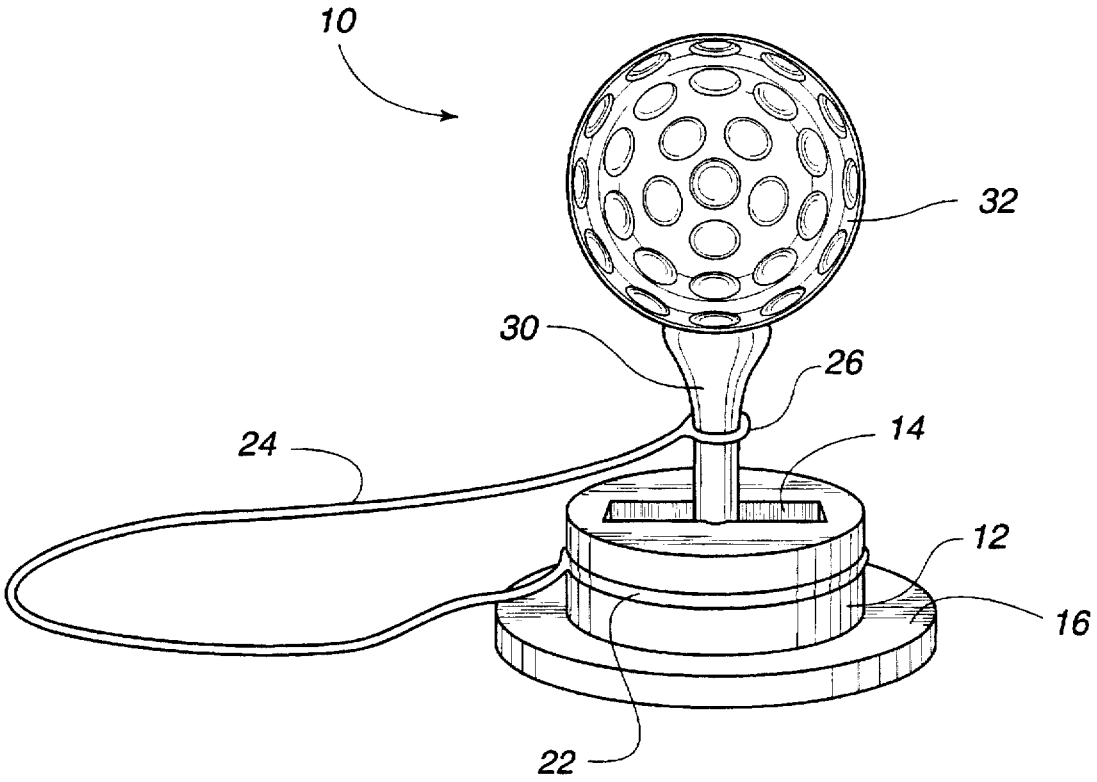
FIG. 1 illustrates a preferred embodiment of the golf tee setter.

A golf tee setter according to various embodiment of the present invention is shown in the drawings for purposes of illustration. In particular, a preferred embodiment of the present invention is illustrated in FIG. 1. According to this embodiment, the golf tee setter 10 includes a tee holder 12, a base 16, a slit 14 formed in the tee holder 12 and a cord 24.

The tee holder 12 is mounted to the base 16 in a substantially upright position. The diameter of the base 16 is slightly larger than that of the tee holder 12 to allow the present invention to stand freely in upright position. The base 16 has substantially circular shape, but may be formed of any shape, such as a square or oval. Preferably, the tee holder 12 is molded of one-piece construction with the base 16, which may be integrally made with rubber or other flexible plastic materials. The tee holder 12 is of a cylindrical shape and may or may not have a hollow interior. The tee holder 12 has a slit 14 on the top which holds a tee 30 sufficiently tight to place a golf ball 32 on the top of the tee 30. If the tee holder 12 is formed of a solid cylindrical member, then the slit 14 may extend all the way to the base 16 of the golf tee setter 10, as shown in FIG. 2.

The height of the golf tee holder assembly 10 is preferably the same as the height of practice mats in driving ranges so that the tee 30 will protrude above the surface of the practice mats. However, the golf tee holder assembly 10 may be of any desirable height. The diameter of the tee holder 12 is preferably slightly less than the diameter of the hole of the practice mat so that the tee holder 12 can snugly fit into the mounting of the practice mat without tilting. Similarly, the diameter of the base 16 should be larger than the diameter of the hole of the practice mat so that the golf tee holder assembly does not slip out from the practice mat after each swing with a golf club.

Figure 2:
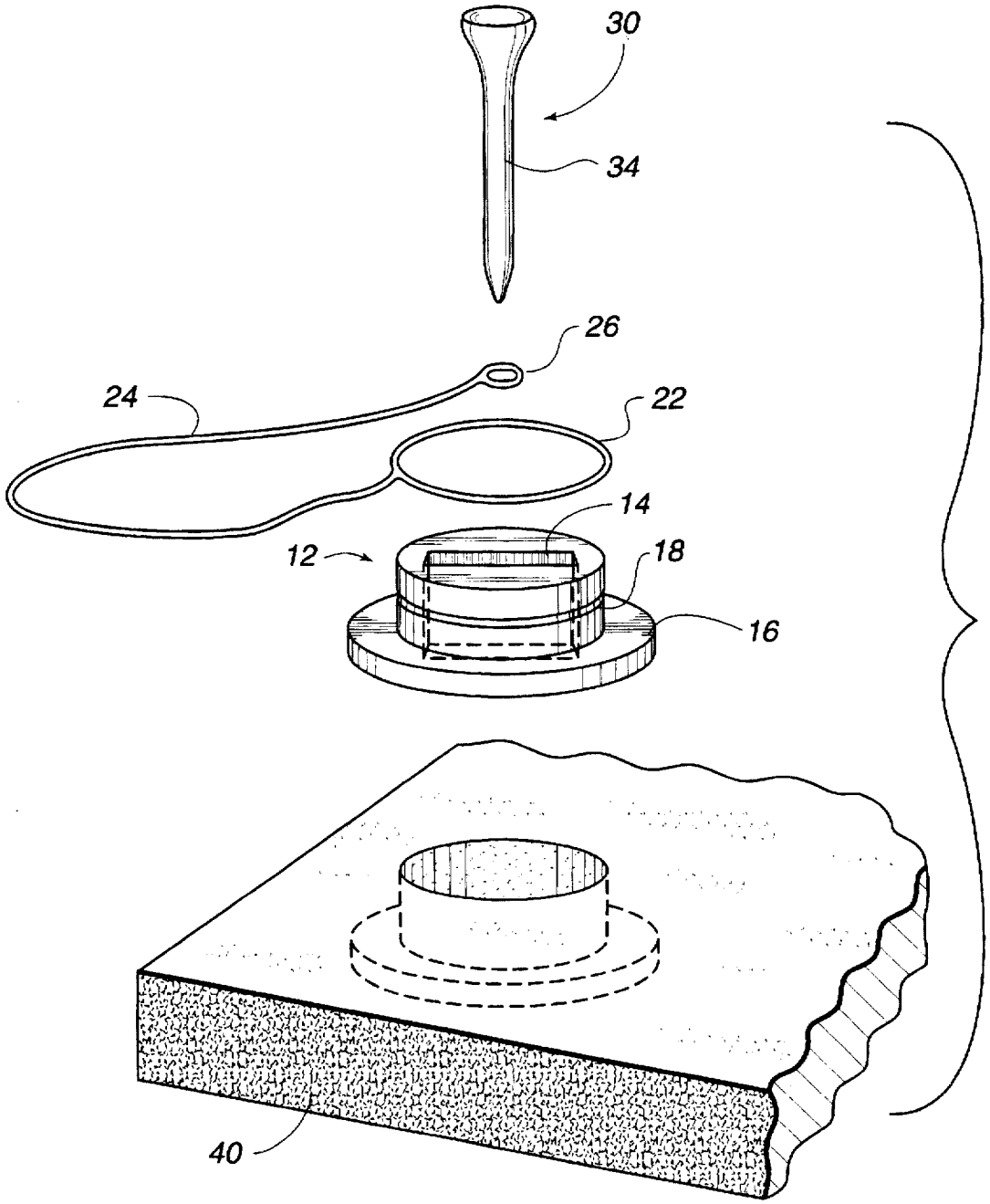
FIG. 2 illustrates an exploded view of FIG. 1.

FIG. 2 illustrates an exploded view of the preferred embodiment of the present invention. The practice golf tee setter 10 has a cord 24 having two ends 22 and 26, in which a first end 22 is coupled to the tee holder 12 and a second end 26 is coupled to the golf tee 30. The cord 24 is preferably made of an elastic material and is about 9–15 inches long. Alternatively, the cord 24 may be made of a non-elastic material, such as nylon, and the length may be longer to suit each individual's need. Moreover, the golf tee setter 10 may even be used without the cord 24.

In the preferred embodiment, the first end 22 slides onto a groove 18 formed on the outer circumference of the tee holder 12. Preferably, the groove 18 is formed on the substantially middle of the longitudinal length of the tee holder 12. However, the groove 18 may be formed on any place on outer circumference of the tee holder 12. Alternatively, the cord may be coupled between the golf tee 30 and the tee holder 12 in any suitable manner, so long as the cord can tether the golf tee 30 with the tee holder 12.

Because the first end 22 of the cord 24 is elastic, the first end 22 can be expanded when slid onto the tee holder 12 and will shrink back to its normal form and shape once it reached the groove 18. In the preferred embodiment of the present invention, the diameter of the second end 26 is slightly smaller than a typical diameter of the spike portion 34 of the tee 30. Such configuration allows the second end 26 of the cord 24 to tightly slide onto the spike portion 34 of the tee 30.

Figure 3A:
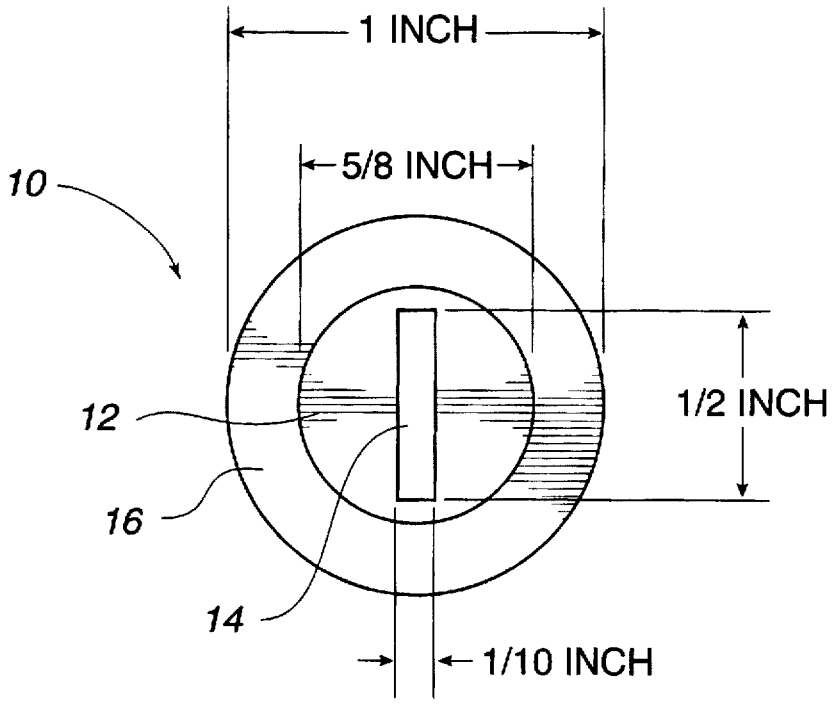
FIG. 3*a* illustrates a top plan view of the preferred embodiment of the present invention.

The physical configuration and construction of the preferred embodiment of the present invention will now be described with reference to FIG. 3*a*. As shown in FIG. 3*a*, which illustrates a top plan view of the preferred embodiment, the diameter of the cylindrical base 16 is approximately 1 inch and the diameter of the cylindrical tee holder 12 is approximately ⅝ inches. The diameter of the tee holder 12 may be changed to fit the holes formed in the practice mats to accommodate conventional rubber tees. The diameter of the base 16 is larger than that of the tee holder 12 so that the tee setter 10 remains in the practice mat.

FIG. 3*a* further illustrates the substantially rectangular slit 14. The width of the rectangular slit 14 is sufficiently small to tightly hold a regular size golf tee. The rectangular slit 14 is formed within the tee holder 12 and has a dimension of approximately ½ inches by 1/10 inches. The rectangular slit 14 is configured to release the golf tee 30 when a golf club head makes an impact with the golf ball placed on the tee 30. It will be understood that the present invention is not be limited to the particular shapes of the slit 14 mentioned above, because many other shapes can be used to form the slit by present invention.

Figure 3B:
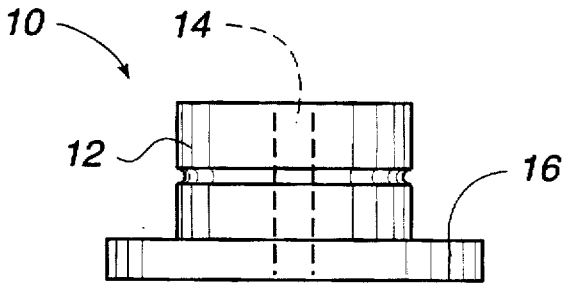
FIG. 3*b* illustrates a front elevational view of the preferred embodiment of the present invention.

FIG. 3*b* illustrates a front elevational view of the preferred embodiment of the present invention. The dotted line indicates the length of the rectangular slit 14, which extends all the way down to the base 16. The preferred embodiment has an open bottom end to allow the users to easily clean the inside of the slit 14. As shown in FIG. 3*b*, the height of the golf tee setter 10 is substantially the same as the height of the practice mat to simulate smooth hitting surface.

Figure 4:
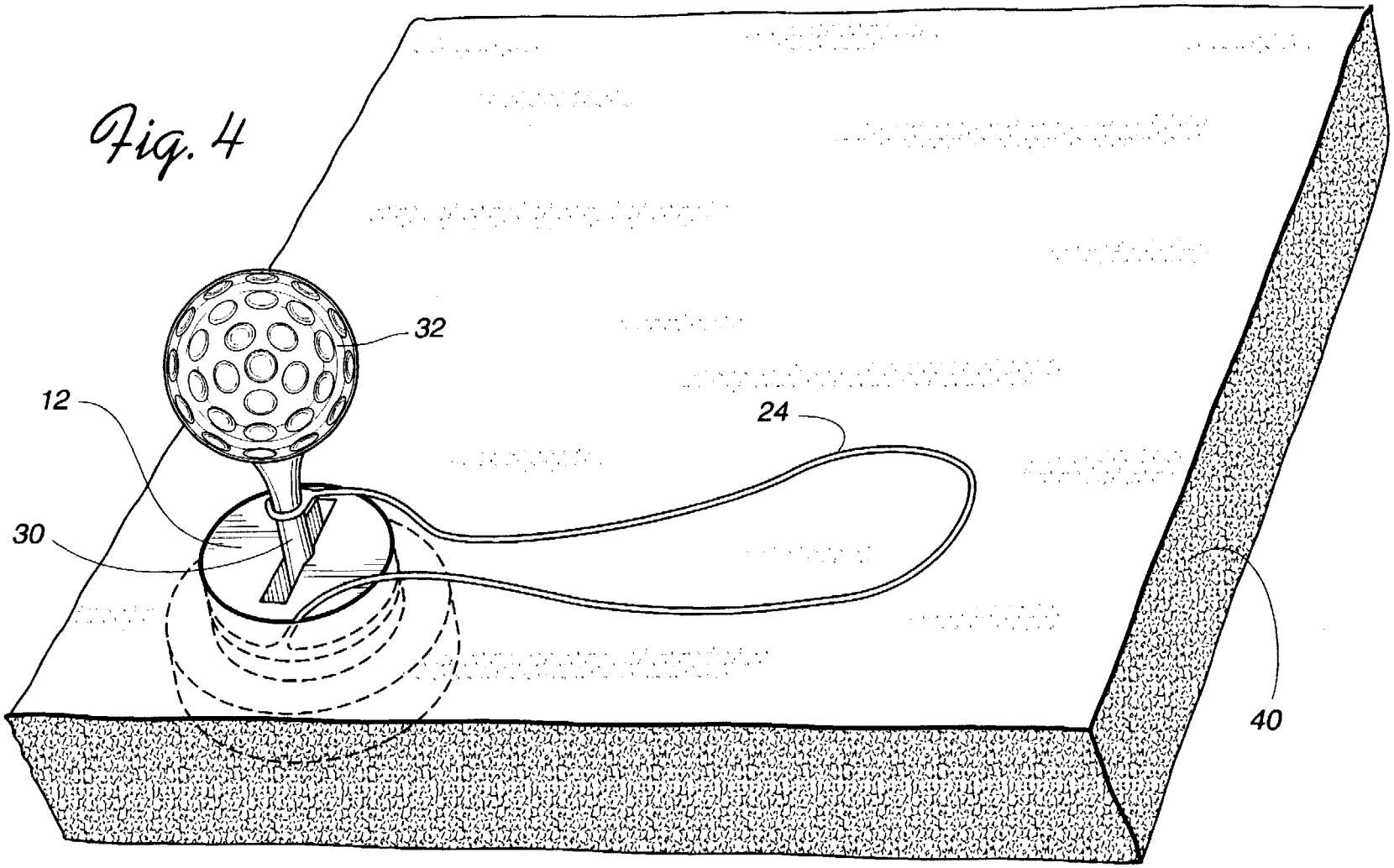
FIG. 4 illustrates a view of the preferred embodiment of the present invention placed in a practice mat 40.

FIG. 4 illustrates a view of the preferred embodiment of the present invention placed in a practice mat 40. The tee holder 12 is inserted into the hole formed by the practice mat 40 so that when a golf tee 30 is placed into the rectangular slit 14, the only members exposed to a golf club is a tee 30 and a golf ball 32.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A golf tee setting device for use with a tee and a practice mat, the golf tee setting device comprising:

a first member configured for placing in the practice mat, wherein the first member has a solid interior;

a second member coupled to a bottom portion of the first member, the second member having a larger diameter than the first member, and a slit lengthwise formed in the first member and extending through the solid interior for holding the tee in a substantially vertical position.

2. A golf tee setting device of claim 1, further comprising a cord having a first end and a second end, wherein the first end of the cord is used for coupling to the first member and the second end is used for coupling to the tee.

3. A golf tee setting device of claim 2, wherein the cord is elastic.

4. A golf tee setting device of claim 2, wherein the cord is non-elastic.

5. A golf tee setting device of claim 2, wherein the first end of the cord is of substantially a ring shape to insert the first member therein.

6. A golf tee setting device of claim 6, wherein the first member includes a groove formed on the outer circumferential surface to accommodate the first end of the cord.

7. A golf tee setting device of claim 2, wherein the second end of the cord is of substantially a ring shape for inserting the tee therein.

8. A golf tee setting device of claim 1, wherein the height of the golf tee setting device is substantially the same as the thickness of the practice mat.

9. A golf tee setting device of claim 1, wherein the slit is sized to hold the golf tee sufficiently tight to hold the tee in substantially vertical position.

10. A golf tee setting device of claim 9, wherein the slit is substantially rectangular in shape.

11. A golf tee setting device for use with a tee and a practice mat the golf tee setting device comprising:

a tee holder configured for placing in the practice mat, wherein the first member has a solid interior;

a slit lengthwise formed in the tee holder and extending through the solid interior for holding the tee in substantially vertical position;

a base coupled to a bottom portion of the tee holder, the base having a larger diameter than the tee holder; and a cord having a first end and a second end, wherein the first end of the cord is coupled to the tee holder and the second end is coupled to the tee.

12. A golf tee setting device of claim 11, wherein the cord is elastic.

13. A golf tee setting device of claim 11, wherein the cord is non-elastic.

14. A golf tee setting device of claim 11, wherein the first end of the cord is of substantially a ring shape to insert the tee holder therein.

15. A golf tee setting device of claim 14, wherein the tee holder includes a groove formed on the outer circumferential surface to accommodate the first end of the cord.

16. A golf tee setting device of claim 11, wherein the second end of the cord is of substantially a ring shape to insert the golf tee therein.

17. A golf tee setting device of claim 11, wherein the height of the golf tee setting device is substantially the same as the thickness of the practice mat.

18. A golf tee setting device for use with a tee and a practice mat, the golf tee setting device comprising:

holding means for holding a tee, wherein the holding means has a solid interior and is configured for placing in the practice mat;

a slit lengthwise formed in the holding means extending through the solid interior for holding the tee in substantially vertical position;

base means coupled to a bottom portion of the holding means having a larger diameter than the holding means; and means for coupling the holding means and the base means, wherein the coupling means has a first end and a second end, and wherein the first end of the coupling means is used for coupling to the holding means and the second end is used for coupling to the tee.

* * * * *